US007351098B2

(12) United States Patent
Gladd et al.

(10) Patent No.: US 7,351,098 B2
(45) Date of Patent: Apr. 1, 2008

(54) EMI SHIELDED ELECTRICAL CONNECTOR AND CONNECTION SYSTEM

(75) Inventors: Joseph Howard Gladd, Cortland, OH (US); William C Ketterer, Girard, OH (US); Frederick Donald Esenwein, Canfield, OH (US); Terry A. George, Salem, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/403,271

(22) Filed: Apr. 13, 2006

(65) Prior Publication Data

US 2007/0243730 A1 Oct. 18, 2007

(51) Int. Cl.
*H01R 9/05* (2006.01)

(52) U.S. Cl. ..... 439/578; 439/271; 439/609

(58) Field of Classification Search ..... 439/88, 439/271, 578, 607, 609, 610, 675, 840
See application file for complete search history.

(56) References Cited

U.S. PATENT DOCUMENTS 4,824,400 A * 4/1989 Spinner ..... 439/578
4,854,893 A * 8/1989 Morris ..... 439/578
5,938,465 A * 8/1999 Fox, Sr. ..... 439/350
6,396,367 B1 * 5/2002 Rosenberger ..... 333/260
6,554,623 B2 4/2003 Yoshioka
6,592,403 B2 * 7/2003 Kooiman ..... 439/578
6,749,464 B2 * 6/2004 Obata ..... 439/610
6,796,838 B2 9/2004 Yoshioka
7,040,909 B2 * 5/2006 Cairns ..... 439/271
2005/0042922 A1 2/2005 Haller et al.

* cited by examiner

*Primary Examiner*—Thanh-Tam Le
(74) *Attorney, Agent, or Firm*—David P. Wood

(57) ABSTRACT

A shielded electrical connection system has a pair of electrical connectors each comprising an inner insulator housing and an outer housing of conductive material. A shunt member of conductive material contacts conductive plug and socket portions of the respective electrical connectors when mated, to enhance electrical continuity between the outer housings. The shunt member is disposed in a shunt chamber and a connector seal seals the chamber at one end. A terminal attached to a shielded electric cable is disposed in a terminal passage in electrical connector that has a second shunt chamber at an inlet of the terminal passage. A second shunt member engages the conductive shield of the cable in the second shunt chamber and the outer housing of the connector. A cable seal seals an inlet of the second shunt chamber. The outer housing of electrical connector is adapted for connection to a conductive casing for grounding the shielded electrical connection. This outer housing carries a second connector seal for sealing an interface between the outer housing and the conductive casing.

13 Claims, 2 Drawing Sheets

EMI SHIELDED ELECTRICAL CONNECTOR AND CONNECTION SYSTEM

FIELD OF THE INVENTION

This invention relates to an electrical connector and connection system that is shielded to prevent electromagnetic interference with electronic devices in the vicinity. Such devices are commonly referred to as EMI shielded electrical connectors and connection systems.

BACKGROUND OF THE INVENTION

Motor vehicles that use internal combustion engines as well as electric motors to power the vehicle are referred to as hybrid vehicles. Hybrid vehicles use high voltage batteries and power generating devices, such as inverters and DC to DC converters which have a voltage on the order of 42 volts to 500 volts. Electrical connections for the high voltage batteries and power generating devices are typically EMI shielded electrical connections.

Recent developments in hybrid vehicles has resulted in configurations where the power generating devices are electrically connected to a vehicle chassis ground. This has resulted in the need for an EMI shielded electrical connection where the electrical terminals and the shield components of the electrical connection are isolated from each other electrically to avoid establishment of a short circuit between the electrical terminals and the EMI shield.

SUMMARY OF THE INVENTION

In one aspect this invention provides a shielded electrical connector having an inner insulator housing and an outer housing of conductive material. The inner insulator housing has an inner longitudinal terminal passage that extends through it from a terminal inlet to a terminal outlet. A shielded electric cable has a conductive core, an inner insulation jacket, a conductive shield outward of the inner insulation jacket, and an outer insulation jacket outward of the conductive metal shield. A terminal is attached to an end portion of the electric cable and that is in electrical contact with the conductive core. The terminal is preferably removeably, disposed in the terminal passage of the inner insulator housing with the electric cable extending out of the terminal inlet of terminal passage. A shunt member of conductive material contacts the conductive shield of the cable and the outer housing of conductive plastic material to enhance electrical continuity between the conductive shield and the outer housing of conductive plastic material.

The shunt member is preferably disposed in a shunt chamber that communicates with the terminal inlet and preferably a cable seal engages the outer insulation jacket of the shielded electric cable and an inlet of the shunt chamber to seal the shunt chamber at one end.

The shunt member may be selected from a group consisting of a coiled metal spring, a stamped metal spring contact, a conductive plastic spring contact, and a conductive elastomeric seal.

In another aspect, the invention provides a shielded electrical connection system having a first electrical connector and a second electrical connector. The first electrical connector comprises a first inner insulator housing and a first outer housing of conductive material that has a plug portion. The second electrical connector comprises a second inner insulator housing and a second outer housing of conductive plastic material that has a socket portion for receiving the plug portion of the first outer housing. A shunt member of conductive material contacts the plug portion and the socket portion when the plug portion is plugged into the socket portion to enhance electrical continuity between the first outer housing and the second outer housing.

The shunt member may be selected from a group consisting of a coiled metal spring, a stamped metal spring contact, a conductive plastic spring contact, and a conductive elastomeric seal.

The shunt member is preferably disposed in a shunt chamber defined by the plug portion and the socket portion and the shielded electrical connection system preferably includes a connector seal engaging the socket portion and the plug portion to seal the shunt chamber at one end.

In still another aspect, one inner housing of the shielded electrical connection system has an inner longitudinal terminal passage that extends through it from a terminal inlet to a terminal outlet, and the shielded electrical connection system includes a shielded electric cable that has a conductive core, an inner insulation jacket, a conductive shield outward of the inner insulation jacket, and an outer insulation jacket outward of the conductive shield, and a terminal that is attached to an end portion of the electric cable and that is in electrical contact with the conductive core. The end portion of the electric cable and the terminal are disposed in the terminal passage of the one inner housing with the electric cable extending out of the terminal inlet of the terminal passage. A cable seal may engage the outer insulation jacket of the electric cable and the electrical connector having the one inner housing to seal the inlet of the terminal passage.

This connector may have a second shunt chamber communicating with the terminal inlet, and a second shunt member that is disposed in the second shunt chamber engaging the conductive shield of the cable and the connector's outer housing of conductive plastic material. The connector may include a cable seal that engages the outer jacket of the cable and an enlarged inlet of the second shunt chamber to seal the second shunt chamber as well as the inlet of the terminal passage.

Either or both of the shunt members may be a metal spring ring, a stamped metal spring contact, a conductive plastic spring contact or a conductive elastomeric seal.

The inner housing of the mating electrical connector preferably has a mating terminal passage that communicates with the terminal passage of the one inner housing when the first electrical connector is mated to the second electrical connector in which case the shielded electric connection system preferably includes an annular elastomeric connector seal for sealing an interface of the inner housings.

The outer housing of the mating electrical connector may be adapted to be grounded, for instance by being adapted to be connected to a conductive casing, in which case, the outer housing preferably carries a second connector seal for sealing an interface between the outer housing and the conductive casing.

DETAILED DESCRIPTION OF PREFERRED EMBODIMENT

Figure 1:
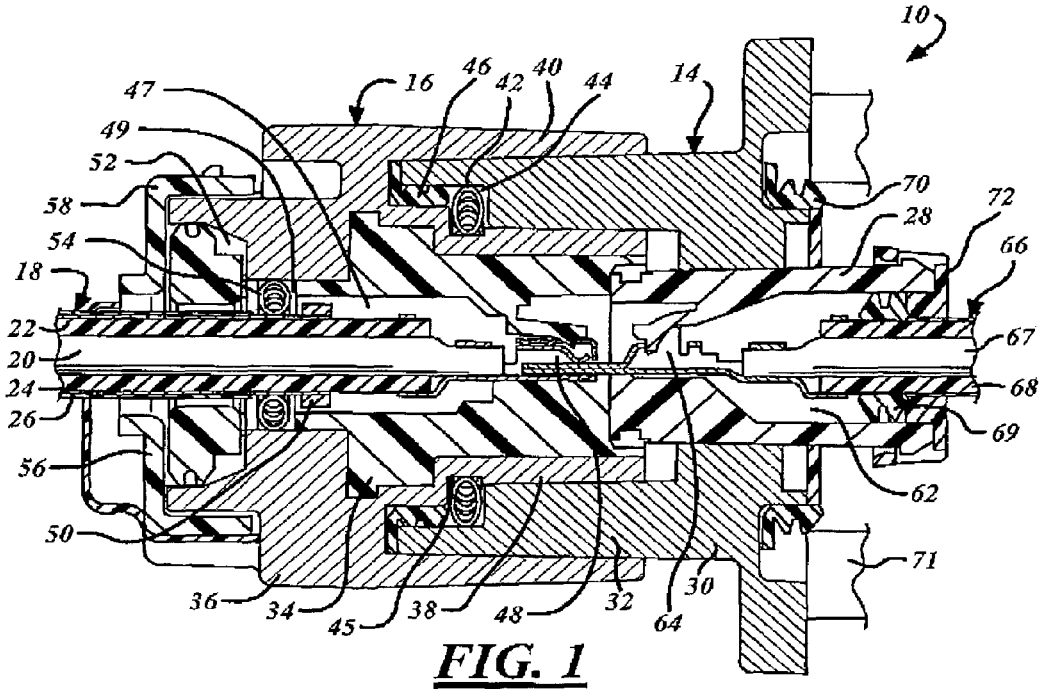
FIG. 1 is a longitudinal section of a shielded electrical connection system of the invention.

Referring now to FIG. 1, the shielded electrical connection system 10 comprises a male connector 14 that is adapted for attachment to a case (not shown), and a female connector 16 that is mated to the male connector 14. The case serves as an electrical ground and is preferably made of metal. As an aside, male connector 14 is labeled male for convenience simply because it contains a male terminal or terminals while female connector 16 is labeled such because it contain a female terminal or terminals. Consequently labels such as male connector or female connector are to be considered terms of convenience and not terms of limitation. For instance, the "female" connector can just as easily house a male terminal and be labeled a "male" connector and vice-versa without departing from the spirit and scope of the invention. The labels assigned to the connectors 14 and 16 is not important. The important feature is that the connectors 14 and 16 as well as the respective terminals that they contain mate in a connection system. Consequently, the male and female connectors 14 and 16 are hereafter referred to as first and second electrical connectors or simply as electrical connectors.

The first electrical connector 14 comprises a first inner housing 28 of non-conductive material and a first outer housing 30 of conductive material that has a socket portion 32. On the other hand, the second electric connector 16 comprises a second inner housing 34 of non-conductive material and a second outer housing 36 of conductive material that has a plug portion 38. Socket portion 32 receives the plug portion 38 of the first outer housing 36 when the electrical connectors 14 and 16 are mated as shown in FIG. 1. Outer housing 36 preferably includes an integral hood or shroud 40 that fits around socket portion 32.

When the electrical connectors 14 and 16 are mated, the outer housings 30 and 36 being of a conductive material form part of a magnetic circuit that depends in part on the fit of the plug portion 38 in socket portion 32. The connection system 10 includes a shunt member 42 of magnetic material that contacts the plug portion 38 and the socket portion 32 when the plug portion 38 is plugged into the socket portion 32 to enhance electrical continuity between the first outer housing 30 and the second outer housing 36. The electrical continuity is also preferably enhanced by a snug fit of socket portion 38 in hood 40.

Shunt member 42 may take the form of a coiled metal spring ring that is disposed in a shunt chamber 44 that is formed near the open end of the socket portion 32 by the plug portion 38 and the socket portion 32 when electrical connector 16 is plugged into electrical connector 14. Shunt member 42 is preferably partially disposed in an annular groove 45 of plug portion 38 for retention with electrical connector 16 when it is unplugged. The connection system 10 also preferably includes an annular connector seal 46 of elastomeric material that engages plug portion 38 and socket portion 32 to seal chamber 44 at the open end of socket portion 32 and protect shunt member 42 from damage by water and other deleterious matter.

In one aspect, an important component of the shielded electrical connection system 10 is the electrical connector 16 that is attached to a shielded electric cable 18. By way of background, a shielded electric cable, such as cable 18, comprises a inner conductive core 20, an inner insulation jacket 22 that surrounds the inner conductive core 20 and a conductive shield 24 that is covered by an outer insulation jacket 26. Conductive shield is usually a metal wire mesh that is woven around the inner insulation jacket 22.

The inner housing 34 of electrical connector 16 has an inner longitudinal terminal passage 47 that extends through it from a terminal inlet to a terminal outlet. A terminal 48 is attached to an end portion of the electric cable 18 so that it is in electrical contact with the conductive core 20. Terminal 48 and the end portion of electric cable 18 are disposed in terminal passage 47 with cable 18 extending out of the terminal inlet and through a communicating shunt chamber 49 formed by outer housing 36 behind inner housing 34. Shielded electric cable 18 has an inner end of its conductive shield 24 stripped and terminated by a compression ring 50 located at the inlet of terminal passage 47.

Shunt chamber 49 has an enlarged inlet 52. Electrical connector 16 preferably includes a second shunt member 54 in the shunt chamber 49 that contacts the conductive shield 24 of cable 18 and the inner wall of shunt chamber 49 to enhance electrical continuity between conductive shield 24 and the outer housing 36 of conductive material. Shunt member 54 may also be a coiled metal spring ring. Cable 18 which extends through inlet 52 is preferably prepared so that conductive shield 24 is exposed in the inner end of the chamber 49 for contact with shunt member 54 while the outer insulation jacket 26 is left on the portion of the cable 18 that is disposed in the enlarged inlet 52.

The outer housing 36 of electrical connector 16 is preferably molded of a conductive plastic material. Inner insulator housing 34 is also preferably molded of a non-conductive plastic material and the outer housing 36 is preferably molded over the inner housing 34 of non-conductive plastic material.

Electrical connector 16 also preferably includes a cable seal 56 behind shunt member 54 to seal the inlet 52 of the shunt chamber 49 formed in outer housing 36, around the outer insulation jacket 26 of electric cable 22 to protect the second shunt member 54 against damage from water and other deleterious matter.

Electrical connector 16 also may include an optional terminal position assurance (TPA) device 58 that is attached to the end of outer housing 30. TPA device 58 operates in a well known manner to insure that terminal 48 is fully inserted and properly positioned in terminal passage 47. It should be noted that terminal 48 can be removed from terminal passage 47 through the shunt chamber 49 for repair or replacement on the end of electric cable 18. Terminal 48 may be retained in terminal passage 47 by a releasable latch tang that must be released before terminal 48 can be removed.

The electrical connection system 10 also includes a mating electric connector 14 which for convenience is termed the second electrical connector as indicated above. The inner housing 28 of electrical connector 14 also has an inner longitudinal terminal passage 62 that extends through it from a terminal inlet to a terminal outlet. A terminal 64 is attached to an end of a non-shielded electric cable 66 that has a conductive core 67 and an outer insulation jacket 68. Terminal 64 and the end portion of electric cable 66 are disposed in terminal passage 62 with cable 66 extending out of the terminal inlet.

Electrical connector 14 also may include an annular elastomeric cable seal 69 that engages the outer insulation jacket of electric cable 66 and the terminal passage 62 to seal the inlet of the terminal passage 62 around the insulation jacket 68 of electric cable 66.

The outer housing 32 of electrical connector 14 is also preferably molded of a conductive plastic material. Inner insulator housing 28 is also preferably molded of a non-conductive plastic material and the outer housing 32 is preferably molded over the inner housing 28 of non-conductive plastic material.

The shielded electrical connection system 10 is grounded by the outer housing 30 of electrical connector 14. Thus the outer housing 30 may be adapted for attachment to a conductive casing 71 having an inlet for receiving the projecting portion of inner housing 28. In such a case, as shown in FIG. 1, electric connector 14 can be adapted for attachment to a casing (not shown) by bolts or the like with the end of inner housing 28 extending into the casing through an inlet in the casing. When electrical connector 14 is attached to such a casing and electrical connector 16 is plugged into connector 14 a shielded electric connection is established from the conductive core 20 of the shielded electric cable 18 to the components inside the casing via mating terminals 48 and 64. A magnetic circuit is also established from the conductive shield 24 of cable 18 to the casing via the outer housings 30 and 36 which are preferably molded of conductive plastic material. This magnetic circuit is enhanced by shunt members 40 and 54.

Electrical connector 14 also may include an interface seal 70 for engaging an inner surface of the inlet of casing 71 to prevent ingress of water and other deleterious matter. Electrical connector 14 may also include an optional terminal position assurance (TPA) device 72 that is attached to the end of inner housing 28. TPA device 72 operates in a well known manner to insure that terminal 64 is fully inserted and properly positioned in terminal passage 62. It should be noted that terminal 64 can be removed from terminal passage 62 via the terminal inlet for terminal passage 62 for repair or replacement on the end of electric cable 66. Terminal 64 may be retained in terminal passage 62 by a releasable latch tang that must be released before terminal 64 can be removed.

Figure 2:
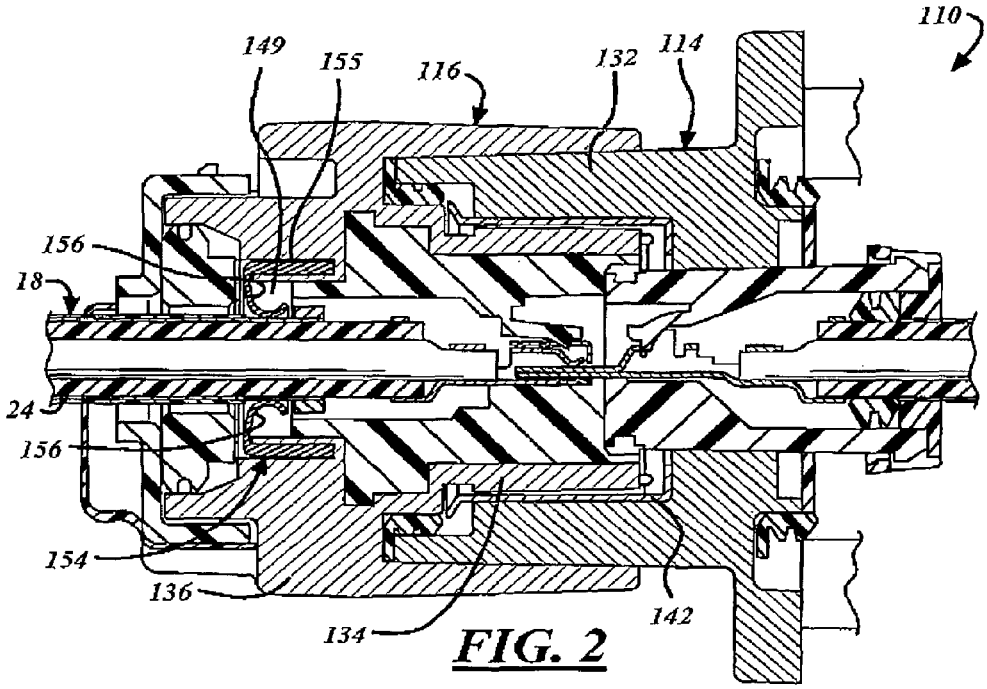
FIG. 2 is a longitudinal section of another shielded electrical connection system of the invention.

Referring now to FIG. 2, the electrical connection system 110 is similar to the electrical connection system 10 described in connection with FIG. 1. The difference between the electrical connection system 110 and the electrical connection system 10 is in the construction of the shunt members 42 and 54 of the electrical connector 16 vis-a-vis the shunt members 142 and 154 of electrical connector 116. As indicated above, the shunt members 44 and 54 are in the form of annular coil springs. In the electrical connection system 110, shunt member 142 is in the form of a stamped metal spring contact that is cup-shaped so that it fits in the socket portion 132 of electrical connector 114 and engages the plug portion 134 when the electrical connector 116 is plugged into electrical connector 114. On the other hand, the shunt member 154 is a stamped metal spring contact comprising a ring 155 that is attached to outer housing 136 and radial spring fingers 156 with curved inner ends that engage the metal shield 24 of cable 18 in shield chamber 49. The electrical connection system 110 is otherwise the same as the electrical connection system 10 and like parts are identified with the same numerals.

Figure 3:
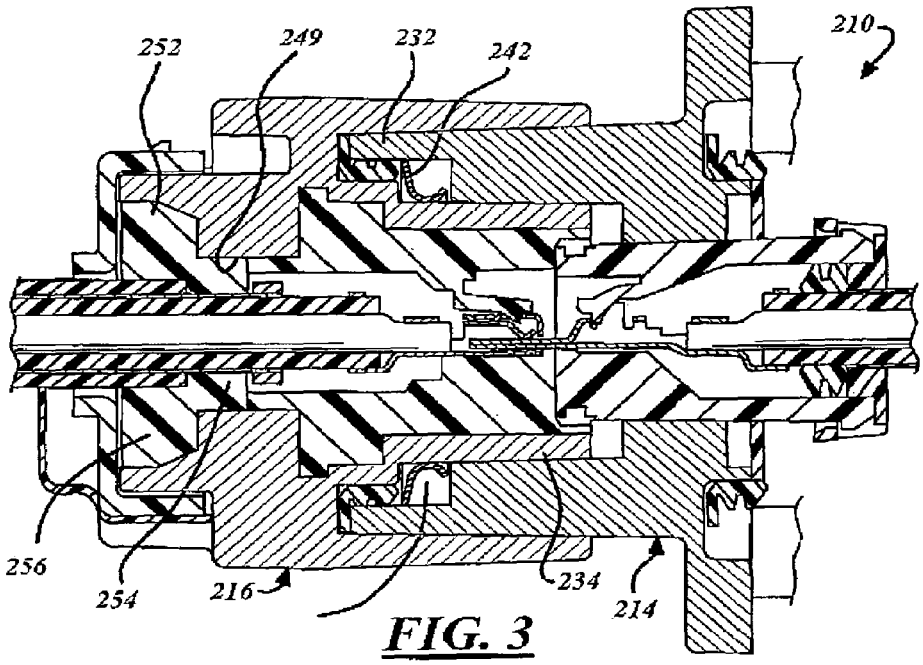
FIG. 3 is a longitudinal section of still another shielded electrical connection system of the invention.

Referring now to FIG. 3, the electrical connection system 210 is also similar to the electrical connection system 10 described in connection with FIG. 1. The difference between the electrical connection system 210 and the electrical connection system 10 is in the construction of the shunt members 42 and 54 of the electrical connector 16 vis-a-vis the shunt members 242 and 254 of electrical connector 216. As indicated above, the shunt members 42 and 54 are in the form of annular coil springs. In the electrical connection system 210, shunt member 242 is in the form of a conductive plastic spring contact shaped like an annulus that fits in the shunt chamber 244 with an outer edge engaging socket portion 232 and a curved inner surface engaging plug portion 234 when the electrical connector 216 is plugged into electrical connector 214. On the other hand, the shunt member 254 is an integral part of a cable seal 256 that seals the enlarged inlet 252 of shunt chamber 249. In this case the cable seal 256 and integral shunt member 254 are a conductive elastomeric sealant, such as carbon filled silicone, that is cured in place. The electrical connection system 210 is otherwise the same as the electrical connection system 10 and like parts are identified with the same numerals.

Figure 4:
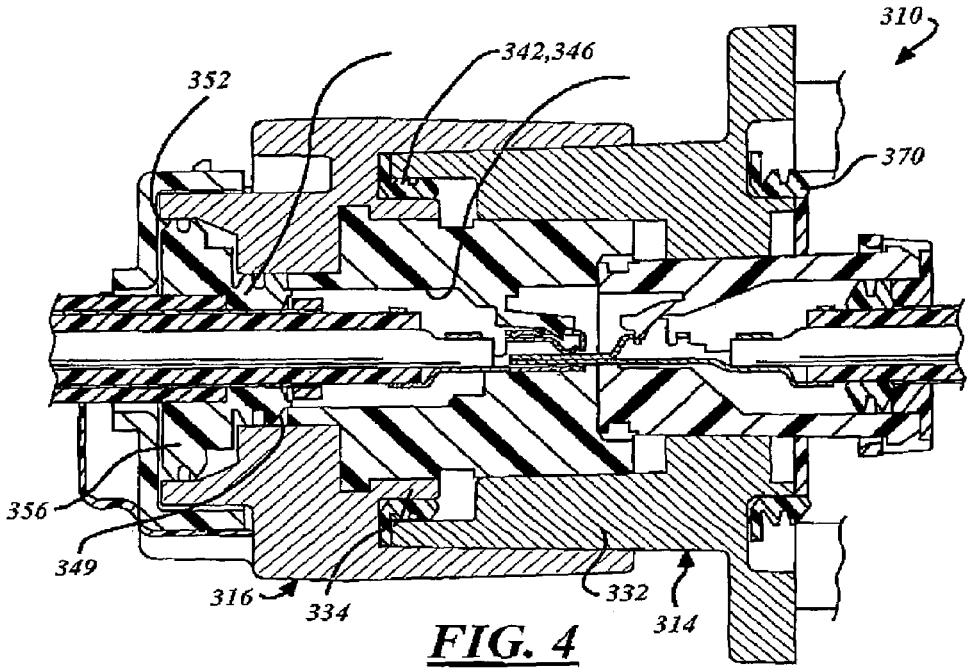
FIG. 4 is a longitudinal section of still yet another shielded electrical connection system of the invention.

Referring now to FIG. 4, the electrical connection system 310 is similar to the electrical connection system 10 described in connection with FIG. 1. The major difference between the electrical connection system 310 and the electrical connection system 10 is in the construction of the shunt members 42 and 54 of the electrical connector 16 vis-a-vis the shunt members 342 and 354 of electrical connector 316. As indicated above, the shunt members 42 and 54 are in the form of annular coil springs. In the electrical connection system 310, shunt member 342 is a part of the elastomeric connector seal 346 that seals the interface of the outer housings 332 and 334 when electrical connector 316 is plugged into electrical connector 314. On the other hand, the shunt member 354 is an integral part of a cable seal 356 that seals the enlarged inlet 352 of shunt chamber 349. Shunt members 354 also seals the outlet of the shunt chamber 349 at the inlet of terminal passage 347. The entire connector seal 346 and the cable seal 356 is preferably made of a conductive elastomeric material. However, it is possible to mold the cable seal 356 so that only the shunt portion 354 is made of a conductive material. The electrical connection system 310 is otherwise the same as the electrical connection system 10 and like parts are identified with the same numerals.

The electrical connection system 310 may also include a connector seal 370 that is made of a conductive elastomeric material to enhance the shield connection to ground when the electrical connector 314 is attached to a conductive casing (not shown) as described above.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A shielded electrical connection system having a first electrical connector and a second electrical connector;

the first electrical connector comprising a first inner insulator housing and a first outer housing of conductive material that has a plug portion, the second electrical connector comprising a second inner insulator housing and a second outer housing of conductive material that has a socket portion for receiving the plug portion of the first outer housing, and a first shunt member of conductive material contacting the plug portion and the socket portion when the plug portion is plugged into the socket portion to enhance electrical continuity between the first outer housing and the second outer housing;

wherein the plug portion and the socket portion define a first shunt chamber, in which the first shunt member is disposed; and wherein one inner housing of the first inner insulator housing and the second inner insulator housing has a second shunt chamber, in which a second shunt member is disposed, wherein the one inner housing has an inner longitudinal terminal passage that extends through it from a terminal inlet to a terminal outlet, and wherein the shielded connection system includes a shielded electric cable that has a conductive core, an inner insulation jacket, a conductive shield outward of the inner insulation jacket, and an outer insulation jacket outward of the conductive shield, and a terminal that is attached to an end portion of the shielded electric cable and that is in electrical contact with the conductive core, the end portion of the shielded electric cable and the terminal being disposed in the terminal passage of the one inner housing with the shielded electric cable extending out of the terminal inlet of the terminal passage, and a cable seal that engages the outer insulation jacket of the shielded electric cable and one electrical connector of the first electrical connector and the second electrical connector to seal the inlet of the terminal passage.

2. The shielded electrical connection system as defined in claim 1, wherein the first inner insulator housing has the second shunt chamber, in which the second shunt member is disposed.

3. The shielded electrical connection system as defined in claim 1 wherein the first shunt member is a coiled metal spring ring.

4. The shielded electrical connection system as defined in claim 1 wherein the shielded electrical connection system includes a connector seal engaging the socket portion and the plug portion to seal the shunt chamber at one end.

5. The shielded electrical connection system as defined in claim 1 wherein the second shunt chamber communicates with the terminal inlet, and wherein the second shunt member engages the conductive shield of the shielded electric cable and an outer housing associated with the one inner housing.

6. The shielded electrical connection system as defined in claim 5 wherein the cable seal engages an enlarged inlet of the second shunt chamber to seal the second shunt chamber as well as the inlet of the terminal passage.

7. The shielded electrical connection system as defined in claim 6 wherein the second shunt member is a metal spring ring.

8. The shielded electrical connection system as defined in claim 6 wherein the second shunt member is a stamped metal spring contact.

9. The shielded electrical connection system as defined in claim 6 wherein the second shunt member and the cable seal are combined into a conductive sealant that is cured in place.

10. The shielded electrical connection system as defined in claim 6 wherein the second shunt member and the cable seal are combined into a conductive elastomeric seal.

11. The shielded electrical connection system of claim 6 wherein the other inner housing has a mating terminal passage that communicates with the terminal passage of the one inner housing when the first electrical connector is mated to the second electrical connector, the shielded electric connection system further comprising an annular elastomeric connector seal for sealing an interface of the inner housings.

12. The shielded electrical connection system of claim 11 wherein the other outer housing associated with the other inner housing is adapted to be grounded.

13. The shielded electrical connection system of claim 12 wherein the other outer housing associated with the other inner housing is adapted to be connected to a conductive casing and carries a second connector seal for sealing an interface between the other outer housing and the conductive casing.

* * * * *